US011008861B2

(12) United States Patent
Guo et al.

(10) Patent No.: US 11,008,861 B2
(45) Date of Patent: May 18, 2021

(54) RAPID CONSTRUCTION METHOD OF PIPE JACKING FOR UNDERGROUND RESCUE TUNNEL WITH LARGE SECTION

(71) Applicant: DALIAN UNIVERSITY OF TECHNOLOGY, Liaoning (CN)

(72) Inventors: Zhenggang Guo, Liaoning (CN); Juan Wang, Liaoning (CN); Shuai Lv, Liaoning (CN); Jiangtao Bi, Liaoning (CN); Deyue Yu, Liaoning (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 0 days.

(21) Appl. No.: 17/031,399

(22) Filed: Sep. 24, 2020

(65) Prior Publication Data

US 2021/0095565 A1 Apr. 1, 2021

(30) Foreign Application Priority Data

Sep. 27, 2019 (CN) ..... 201910924983.0

(51) Int. Cl.
*E21D 9/08* (2006.01)
*E21F 11/00* (2006.01)
(Continued)

(52) U.S. Cl.
CPC ..... *E21F 11/00* (2013.01); *E21D 9/005* (2013.01); *E21D 9/1006* (2013.01); *E21D 9/112* (2013.01)

(58) Field of Classification Search
CPC ..... E21F 11/00; E21D 9/1006; E21D 9/112; E21D 9/06; E21D 9/005; E21D 9/08
(Continued)

(56) References Cited

FOREIGN PATENT DOCUMENTS

CN 202768008 U 3/2013
CN 107420640 A 12/2017
(Continued)

OTHER PUBLICATIONS

Tian, Hongliang, et al., "Technology and equipment for rapid safety construction of emergency rescue channel after mine disaster," Coal Science and Technology, vol. 47, Issue No. 5, May 15, 2019, pp. 29-33.

(Continued)

*Primary Examiner* — Sunil Singh
(74) *Attorney, Agent, or Firm* — Muncy, Geissler, Olds & Lowe, P.C.

(57) ABSTRACT

A rapid construction method of pipe jacking for underground rescue tunnel with large section is disclosed. The present invention realizes rock breaking through the cutting head of a roadheader cutting unit, and pushes pipe jacking forward through a pushing thruster. During the process, a protecting bush fixedly connected with a stretchable part is adopted for circumferential support; and since the cutting head and the protecting bush occupy the rock breaking space, and the pushing thruster pushes pipe jacking forward to push the coal rock in the annular space to the circumferential direction, the effect of moving forward without slag discharge can be achieved. The present invention can establish a rescue tunnel quickly and effectively, which saves rescue time and greatly reduces the threat to the life safety of trapped people. The present invention can establish a fast and safe underground rescue tunnel with large section for the rescue of people.

1 Claim, 2 Drawing Sheets

(51) Int. Cl.

| | |
|---|---|
| ***E21D 9/10*** | (2006.01) |
| ***E21D 9/00*** | (2006.01) |
| ***E21D 9/11*** | (2006.01) |

(58) Field of Classification Search
USPC ..... 405/184, 184.1, 184.2
See application file for complete search history.

(56) References Cited

FOREIGN PATENT DOCUMENTS

| | | | |
|---|---|---|---|
| CN | 108035730 | A | 5/2018 |
| CN | 208474637 | U | 2/2019 |
| JP | H01-322091 | A | 12/1989 |
| JP | H08-284583 | A | 10/1996 |
| JP | 3421681 | B2 | 6/2003 |

OTHER PUBLICATIONS

Zhang, Guangxing, et al., "Construction technology for underground engineering," Wuhan University Press, Mar. 31, 2017, First Edition, pp. 104-106.

RAPID CONSTRUCTION METHOD OF PIPE JACKING FOR UNDERGROUND RESCUE TUNNEL WITH LARGE SECTION

TECHNICAL FIELD

The present invention belongs to the technical field of emergency rescue for coal mine safety production, and relates to a rapid construction method of pipe jacking for underground rescue tunnel with large section.

BACKGROUND

Emergency rescue of coal mine disaster accidents is an important part of mine safety work, and rescue after coal mine collapse becomes the last line of defense to save lives. However, the operating conditions of the coal mine are poor, the geological conditions are complex and changeable, and the construction technology is complicated. At present, the monitoring and control on coal mine safety management are inadequate. If a collapse occurs, the life safety of the trapped people will be seriously threatened. The key to the rescue of coal mine collapse accidents lies in taking scientific and reasonable rescue measures in a short time. The tunnel cross-sections of modern mechanized mines are relatively large, most of which are above 12 $m^2$. For drilling methods, complex situations and accidents such as bit blocked, mine wall chipping and collapse, tools stuck and tools truck sometimes occur, which are not conducive to rescue. The traditional method for rock breaking by a cutterhead has insufficient rock breaking ability when the job object is collapsing coal rock, and slag discharge with such method not only affects the rock breaking ability but also wastes time. After a tunnel collapses, a 100-meter-long tunnel is formed in the collapsed and unstable coal rock. The collapsed pile in the tunnel contains coal rock, rock bolt, anchor cable and the like, the dimensions are complex, and the hardnesses are also different; and the overall characteristics tend to be loose, the geometric dimensions tend to be small, and the geometric shape tend to be complicated. Therefore, in view of the above situation, the present invention provides a rapid construction method of pipe jacking for underground rescue tunnel with large section.

SUMMARY

To solve the above problem, the present invention provides a rapid construction method of pipe jacking for underground rescue tunnel with large section, which can rapidly construct an underground rescue tunnel with large section of pipe jacking for the rescue of people.

The present invention adopts the following solution:

A rapid construction method of pipe jacking for underground rescue tunnel with large section is realized based on a downhole rescue device with large section, wherein the downhole rescue device with large section comprises a roadheader cutting unit 1, a pipe jacking 9 and a pushing thruster.

The roadheader cutting unit 1 comprises a cutting head 1-1, a protecting bush 1-2, a stretchable part 1-3, a cutting reducer 1-4, an electric motor 1-5, a frame body 1-6 and couplings 1-7. The frame body 1-6 is fixed on the tail end of the roadheader cutting unit 1, and the electric motor 1-5 is fixed in the frame body 1-6 and used to provide power; an input shaft of the cutting reducer 1-4 is connected with the electric motor 1-5 through the coupling 1-7, and the electric motor 1-5 transfers the torque to the input shaft of the cutting reducer 1-4 through the coupling; an output shaft of the cutting reducer 1-4 is connected with one end of the stretchable part 1-3 through the coupling 1-7 to transfer the torque to the stretchable part 1-3; the cutting head 1-1 is fixed on the other end of the stretchable part 1-3 to realize the stretch and pitch of the cutting head 1-1; the protecting bush 1-2 is fixed on the periphery of the stretchable part 1-3 to realize circumferential support; the cutting head 1-1 has a tapered structure and is used for rock breaking; and with the continuous advancement of the roadheader cutting unit, the cutting head 1-1 continually breaks the rock.

The pipe-jacking 9 has a circular tube structure, the diameter of the top end part thereof is reduced to form a cone, and the top end of the pipe jacking 9 is sheathed on the periphery of the protecting bush 1-2.

The pushing thruster comprises a relay chamber 2, top iron 3, a main oil cylinder 4, a counter-force apparatus 5, a main top cylinder frame 6, a leveling device 7 and a framework 8. The relay chamber 2 is a ring made of steel, and is located in the middle of the pipe jacking 9 and used to increase thrust; The top iron 3 has an annular structure and has the same inner and outer diameters as the pipe jacking 9, one end of the top iron 3 is connected with the tail end of the pipe-jacking 9, and the other end of the top iron 3 is connected with the main oil cylinder 4 to transfer the thrust to the pipe jacking 9 and uniformly distribute the thrust on the section of the pipe jacking 9; the main oil cylinder 4 is fixed on the main top cylinder frame 6 and used to provide thrust; the main top cylinder frame 6 is fixed on the counter-force apparatus 5 which provides sufficient counterforce for the advancement of the pushing thruster; both ends of the framework 8 are respectively connected with the top iron 3 and the counter-force apparatus 5 for supporting the pushing thruster; the leveling device 7 is placed on the ground and connected with the framework 8 for field leveling; and with the help of the thrust of the main oil cylinder 4 and the relay chamber 2, the pushing thruster pushes the pipe jacking 9 into the tunnel, provides thrust for the pipe jacking 9 to advance, and meanwhile, overcomes the friction between the pipe jacking 9 and the surrounding soil to provide support for the rescue tunnel.

The rapid construction method of pipe jacking comprises the following steps:

Step 1: setting up a downhole rescue device with large section, wherein the initial status is that the cutting head 1-1 of the roadheader cutting unit retracts to 10%-20% of the stroke thereof and the cutting head 1-1 does not rotate.

Step 2: when gradually retracting to the shortest stroke, the cutting head 1-1 begins rotating and realizes rock breaking during rotation.

Step 3: the cutting head 1-1 conducts continuous rotation for rock breaking and advancement; with the continuous extension of the cutting head 1-1, the space behind the section of the cutting head 1-1 is circumferentially supported by the protecting bush 1-2 to withstand the broken gravel in the tunnel; and when extending to the longest stroke, the cutting head 1-1 stops rotating.

Step 4: after the cutting head 1-1 stops rotating, because the cutting head 1-1 and the protecting bush 1-2 occupy the rock breaking space, the pushing thruster pushes the pipe jacking 9 forward to push the coal rock in the annular space to the circumferential direction so as to achieve the effect of moving forward without slag discharge; then the cutting head 1-1 of the roadheader cutting unit retracts to provide more slag discharge space and reduce the axial force required for pushing the pipe-jacking; and the pushing thruster continues pushing the pipe jacking 9 forward, and stops pushing until the cutting head 1-1 retracts to 70%-80% of the stroke thereof.

Step 5: the cutting head 1-1 of the roadheader cutting unit retracts to the initial status.

Step 6: repeating step 1 to step 5 to realize rescue operation.

The present invention has the following beneficial effect: The present invention provides a rapid construction method of pipe jacking for underground rescue tunnel with large section, which can establish a rescue tunnel quickly and effectively, saving rescue time and greatly reducing the threat to the life safety of trapped people, thus being suitable for underground rescue with large section.

In the figures: 1 cutting unit; 1-1. cutting head; 1-2. protecting bush; 1-3. stretchable part; 1-4. cutting reducer; 1-5. electric motor; 1-6. frame body; 1-7. coupling; 2. relay chamber; 3. top iron; 4. main oil cylinder; 5. counter-force apparatus; 6. main top cylinder frame; 7. leveling device; 8. framework; and 9. pipe-jacking.

DETAILED DESCRIPTION

The technical solution of the present invention is further described in combination with the drawings but not limited to this. Any modification or equivalent replacement of the technical solution of the present invention without departing from the purpose and the scope of the technical solution of the present invention shall be covered within the protection scope of the present invention.

Figure 1:
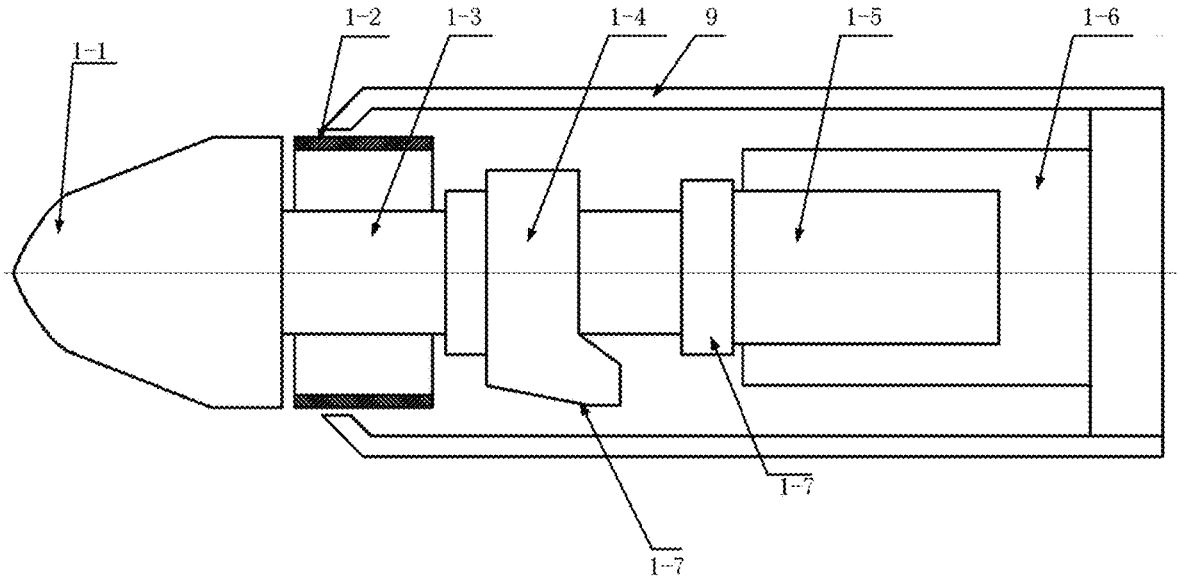
FIG. 1 is a structural schematic diagram of a roadheader cutting unit of the present invention.
Figure 4:
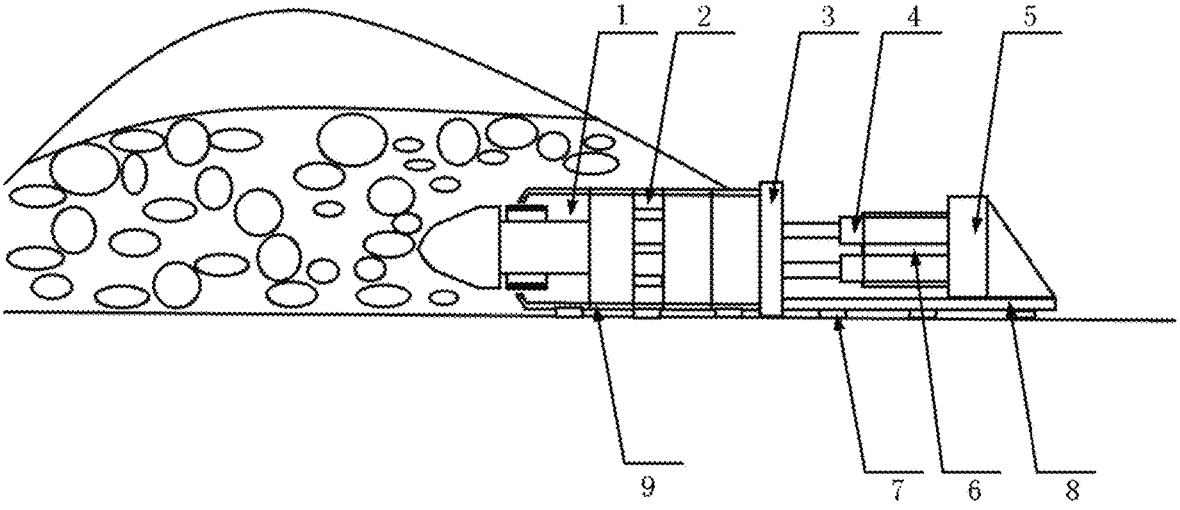
FIG. 4 is a schematic diagram of a longitudinal working section in a rescue channel.

As shown in FIG. 1 and FIG. 4, the downhole rescue device with large section comprises a roadheader cutting unit 1, a pushing thruster and a pipe jacking 9.

The roadheader cutting unit 1 comprises a cutting head 1-1, a protecting bush 1-2, a stretchable part 1-3, a cutting reducer 1-4, an electric motor 1-5, a frame body 1-6 and couplings 1-7. The cutting head 1-1 has a tapered structure, and the cutting head 1-1 is fixed on the front end of the stretchable part 1-3 and used for rock breaking; the protecting bush 1-2 is fixed on the periphery of the stretchable part 1-3 to realize circumferential support; the stretchable part 1-3 is located between the cutting head 1-1 and the cutting reducer 1-4 for stretch and pitch; an input shaft of the cutting reducer 1-4 is connected with the electric motor 1-5 through the coupling 1-7, and an output shaft transfers the torque to the stretchable part 1-3 through the coupling 1-7; the electric motor 1-5 is used to provide power; the frame body 1-6 is arranged on the rear end of the electric motor 1-5 and used for fixing the electric motor 1-5; two couplings 1-7 are provided to firmly connect the cutting reducer 1-4 with the stretchable part 1-3 and the cutting reducer 1-4 with the electric motor 1-5 and to transfer motion and torque; and with the continuous advancement of the roadheader cutting unit 1, the cutting head 1-1 continually breaks the rock.

The pipe jacking 9 has a circular tube structure, the diameter of the top end part thereof is reduced to form a cone, and the top end of the pipe jacking 9 is sheathed on the periphery of the protecting bush 1-2.

The pushing thruster comprises a relay chamber 2, top iron 3, a main oil cylinder 4, a counter-force apparatus 5, a main top cylinder frame 6, a leveling device 7 and a framework 8. The relay chamber 2 is a ring made of steel, and is located in the pipe jacking 9 and used to increase thrust; The top iron 3 has an annular structure and has the same inner and outer diameters as the pipe-jacking 9, one end of the top iron 3 is connected to the tail end of the pipe-jacking 9, and the other end of the top iron 3 is connected with the main oil cylinder 4 to transfer the thrust to the pipe-jacking 9 and uniformly distribute the thrust on the section of the pipe-jacking 9; the main oil cylinder 4 is fixed on the main top cylinder frame 6 and used to provide thrust; the counter-force apparatus 5 is fixed on the main top cylinder frame 6 to provide sufficient counterforce for advancement; the framework 8 is used to support the pushing thruster, the front end thereof is connected with the top iron 3, and the tail end is connected with the counter-force apparatus 5; and the leveling device 7 is placed on the ground and connected with the framework 8 for field leveling.

A rapid construction method of pipe jacking for underground rescue tunnel with large section is mainly realized by breaking the rock by the roadheader cutting unit and pushing the pipe jacking forward by the pushing thruster. In this process, the protecting bush 1-2 fixedly connected with the stretchable part 1-3 is adopted for circumferential support; the cutting head 1-1 and the protecting bush 1-2 occupy the rock breaking space; and the pushing thruster pushes the pipe jacking 9 forward to push the coal rock in the annular space to the circumferential direction so as to achieve the effect of moving forward without slag discharge. The method comprises the following specific steps:

Step 1: after a rapid construction device of pipe jacking for underground rescue tunnel with large section is set up, the initial status is that the cutting head 1-1 of the roadheader cutting unit retracts to 10%-20% of the stroke thereof and the cutting head 1-1 does not rotate.

Step 2: to reduce the starting torque of the cutting head, the cutting head 1-1 retracts to the shortest stroke, then begins rotating and realizes rock breaking during rotation.

Step 3: the cutting head 1-1 conducts continuous rotation for rock breaking and advancement; with the continuous extension of the cutting head 1-1, the space behind the section of the cutting head 1-1 needs support, and the protecting bush 1-2 is adopted for circumferential support (as shown in FIG. 1) to withstand the broken gravel in the tunnel; and when extending to the longest stroke, the cutting head 1-1 stops rotating.

Figure 2:
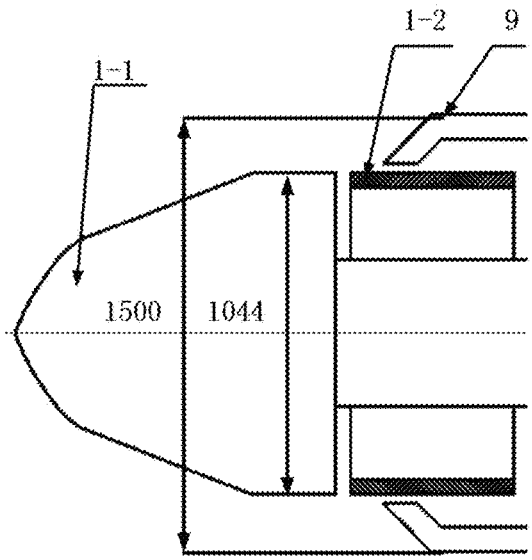
FIG. 2 is a schematic diagram of a cutting head stopping working in a rescue tunnel.
Figure 3:
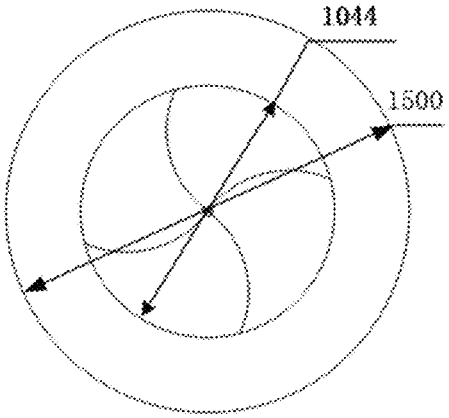
FIG. 3 is a longitudinal schematic diagram of FIG. 2.

Step 4: the pushing thruster pushes the pipe jacking 9 forward, and the cutting head 1-1 of the roadheader cutting unit retracts; and the pushing thruster continues pushing the pipe jacking 9 forward, and stops pushing until the cutting head 1-1 retracts to 70%-80% of the stroke thereof. As shown in FIG. 2 and FIG. 3, after the cutting head 1-1 stops rotating, because rock breaking is completed with the range 1044 shown in FIG. 2 and FIG. 3, the space is occupied by the cutting head 1-1 and the protecting bush 1-2, the pushing thruster pushes the pipe jacking 9 forward to push the coal rock in the annular space between 1500 and 1044 in FIG. 2 and FIG. 3 to the circumferential direction, and the pipe jacking 9 moves forward to the preset position to form a part of the rescue tunnel. In addition, the cutting head 1-1 can also retract moderately to provide more slag discharge space and reduce the axial force required for pushing the pipe-jacking.

Step 5: after the pushing work is stopped, the cutting head 1-1 retracts to the initial status.

Step 6: repeating step 1 to step 5 to realize rescue operation.

The invention claimed is:

1. A rapid construction method of pipe jacking for underground rescue tunnel with a section, wherein the method is realized based on a downhole rescue device with large section, and the rescue device comprises a roadheader cutting unit (1), a pipe-jacking (9) and a pushing thruster;

the roadheader cutting unit (1) comprises a cutting head (1-1), a protecting bush (1-2), a stretchable part (1-3), a cutting reducer (1-4), an electric motor (1-5), a frame body (1-6) and couplings (1-7); the frame body (1-6) is fixed on the tail end of the roadheader cutting unit (1), and the electric motor (1-5) is fixed in the frame body (1-6) and used to provide power; an input shaft of the cutting reducer (1-4) is connected with the electric motor (1-5) through the one of the couplings (1-7), and an output shaft is connected with one end of the stretchable part (1-3) through the one of the couplings (1-7); the cutting head (1-1) is fixed on the other end of the stretchable part (1-3) to realize the stretch and pitch of the cutting head (1-1); the cutting head (1-1) has a tapered structure; the protecting bush (1-2) is fixed on the periphery of the stretchable part (1-3) to realize circumferential support;

the pipe-jacking (9) has a circular tube structure, the diameter of the top end part thereof is reduced to form a cone, and the top end of the pipe jacking (9) is sheathed on the periphery of the protecting bush (1-2);

the pushing thruster comprises a relay chamber (2), top iron (3), a main oil cylinder (4), a counter-force apparatus (5), a main top cylinder frame (6), a leveling device (7) and a framework (8); the relay chamber (2) has a ring structure, and is located in the middle of the pipe-jacking (9) and used to increase thrust; the top iron (3) has an annular structure and has the same inner and outer diameters as the pipe-jacking (9), one end of the top iron (3) is connected with the tail end of the pipe-jacking (9), and the other end is connected with the main oil cylinder (4) to transfer the thrust to the pipe-jacking (9) and uniformly distribute the thrust on a section of the pipe-jacking (9); the main oil cylinder (4) is fixed on the main top cylinder frame (6) and used to provide thrust; the main top cylinder frame (6) is fixed on the counter-force apparatus (5) which provides counterforce for the advancement of the pushing thruster; both ends of the framework (8) are respectively connected with the top iron (3) and the counter-force apparatus (5) for supporting the top iron (3) and the counter-force apparatus (5); the leveling device (7) is placed on the ground and connected with the framework (8);

the rapid construction method of pipe jacking comprises the following steps:

step 1: setting up the downhole rescue device with the section, wherein the initial status is that the cutting head (1-1) retracts to 10%-20% of the stroke thereof and the cutting head (1-1) does not rotate;

step 2: when retracting to a first determined stroke, the cutting head (1-1) begins rotating and realizes rock breaking during rotation;

step 3: the cutting head (1-1) conducts continuous rotation for rock breaking and advancement of the device; with the continuous extension of the cutting head (1-1), a space behind a section of the cutting head (1-1) is circumferentially supported by the protecting bush (1-2); and when extending to a second determined stroke, the cutting head (1-1) stops rotating;

step 4: after the cutting head (1-1) stops rotating, the pushing thruster pushes the pipe-jacking (9) forward to push the rock in the space to the circumferential direction;

then the cutting head (1-1) of the roadheader cutting unit retracts to provide more slag discharge area and reduce the axial force required for pushing the pipe-jacking; and the pushing thruster continues pushing the pipe-jacking (9) forward, and stops pushing until the pushing thruster reaches 70%-80% of an entire telescopic stroke of the cutting head (1-1);

step 5: the cutting head (1-1) of the roadheader cutting unit retracts to the initial status;

step 6: repeating step 1 to step 5 to realize rescue operation.

* * * * *